US007677946B2

(12) United States Patent
Mayer

(10) Patent No.: US 7,677,946 B2
(45) Date of Patent: Mar. 16, 2010

(54) APPARATUS FOR CHILD ACTIVITY AND OCCUPATIONAL THERAPY

(76) Inventor: Peter L. Mayer, 4053 Higel Ave., Sarasota, FL (US) 34242

( * ) Notice: Subject to any disclaimer, the term of this patent is extended or adjusted under 35 U.S.C. 154(b) by 102 days.

(21) Appl. No.: 11/175,586

(22) Filed: Jul. 6, 2005

(65) Prior Publication Data

US 2007/0010160 A1 Jan. 11, 2007

(51) Int. Cl.
*A63H 33/04* (2006.01)
*A63H 33/00* (2006.01)

(52) U.S. Cl. ..... 446/71; 446/73; 434/188; 273/156

(58) Field of Classification Search ..... 446/71, 446/73, 75; 273/156, 153 P; 434/128, 129, 434/177, 188, 276, 365, 393, 433
See application file for complete search history.

(56) References Cited

U.S. PATENT DOCUMENTS 247,302 A * 9/1881 Candy ..... 446/71
4,280,241 A 7/1981 Pfaff
4,978,301 A 12/1990 Dodge
5,145,177 A 9/1992 Wells
5,152,710 A * 10/1992 Montgomery ..... 446/75
5,288,233 A 2/1994 Green
5,330,379 A * 7/1994 Roh et al. ..... 446/71
5,407,201 A 4/1995 Whitehurst
5,525,088 A * 6/1996 Mayne ..... 446/75
5,615,883 A 4/1997 Stevens
5,685,120 A 11/1997 Sihra
5,707,269 A 1/1998 Murphy
5,788,233 A 8/1998 Wolfe
5,860,650 A 1/1999 Scobbie et al.
5,971,826 A * 10/1999 Delzompo et al. ..... 446/75
6,015,150 A 1/2000 Giguere
6,193,581 B1 2/2001 Wiggs et al.
6,234,858 B1 5/2001 Nix
6,364,360 B1 4/2002 Kaufman
6,398,659 B1 6/2002 Karg
6,443,794 B2 * 9/2002 Oren et al. ..... 446/85
6,511,073 B2 * 1/2003 Simonds ..... 273/299
6,540,579 B1 4/2003 Gubitosi et al.
6,572,436 B1 * 6/2003 So ..... 446/478
6,579,100 B1 6/2003 Clark et al.
6,712,396 B2 3/2004 Derraugh
6,857,633 B1 2/2005 Mackey
7,160,170 B2 * 1/2007 Yoon ..... 446/92

* cited by examiner

*Primary Examiner*—Kien T Nguyen
(74) *Attorney, Agent, or Firm*—Fleit Gibbons Gutman Bongini & Bianco; Paul D. Bianco; Martin Fleit

(57) ABSTRACT

The present invention provides interchangeable activity centers having a variety of themes, complexity, or content. Parents, teachers, therapists, or others can select, combine, and arrange two or more activity centers according to a user's interests and capabilities at that time. As the user develops greater skills or begins to lose interest, one or more of the activity centers may be removed, rearranged, or substituted for one or more other activity centers. This may lead to longer interest in the device and better correlate its subject matter with information or materials needed for further development.

19 Claims, 8 Drawing Sheets

APPARATUS FOR CHILD ACTIVITY AND OCCUPATIONAL THERAPY

FIELD OF THE INVENTION

The present invention relates to an apparatus having a plurality of interchangeable activity centers, such as puzzles, games, or moving parts, for promoting child activity or for use as a therapy tool.

BACKGROUND OF THE INVENTION

Parents today have a great variety of toys they can purchase for their children. One of the factors parents may consider when deciding what toy to buy is how long their children may play with the toy before losing interest in it. Another factor parents may consider is whether the toy will help in the development of their children's motor skills or learning ability. Recognizing the importance parents place on these factors, toy manufacturers are constantly working to develop new toys that are either fun to play with or help in childhood development, or both.

However, since every child has his own unique combination of physical and mental development, personality, and interests, he is prone to quickly lose interest in any one toy for a variety of reasons. For instance, some children may have less fun with a toy once they understand how it works. As its operation or outcome becomes routine or well understood, the toy no longer presents a challenge or holds excitement for the child. One example of this tapering of interest is with puzzles. Once a child understands the "secret" of a puzzle and has mastered its solution (i.e., the child is both capable of understanding the secret and also has developed sufficient motor skills to perform tasks associated with the secret), the level of continued interest in the toy can drop significantly.

Conversely, some toys may have features that are too complicated for a child, and therefore also may not be as fun, educational, or helpful in child development. With each unsuccessful attempt to make a toy work, frustration levels may build until some children ultimately give up trying to play with the toy. Similarly, there may be an aspect or feature of a toy that frightens a child. Thus, some children may not enjoy or maintain interest in a toy because of an aspect or feature that is not well-matched to the child's interests, capabilities, or sensitivity.

In many cases there are several aspects of a toy that are well-matched to a child's interests and capabilities, while only a small portion or element may be too difficult, complex, or perhaps frightening. For instance, a toy having an element or feature requiring a certain level of fine motor skills may not be interesting to a child who has not yet developed the necessary skills to competently manipulate its parts. Similarly, a toy having a feature requiring memorization of a series of steps before proceeding may present too much of a challenge for some children. Unfortunately, once a child loses interest in a toy it is difficult to generate renewed interest in it later on, even though the child may have subsequently developed the skills needed to enjoy its more difficult or complicated features.

SUMMARY OF THE INVENTION

The present invention allows for a device (such as a child's toy or a therapy aid) to be custom-tailored to a user's interests and capabilities by utilizing interchangeable activity centers having a variety of themes, complexity, or content. A parent, therapist, or other person can select and combine activity centers according to a user's interests or developmental needs.

One embodiment of the present invention relates to a first plurality of activity centers having a variety of themes, complexity, or content. The activity centers have front and rear surfaces and at least one contact surface. In addition, a base unit may be used to join two or more of the activity centers together. As needed, a parent, physician, user, or other person may later substitute, remove, or rearrange any or a subset of the activity centers.

Without being bound to a particular theory, it is believed, that the ability to make adjustments to the collection of activity centers allows for better enjoyment of the toy or therapy device and better development by the user. In one embodiment, the activity centers are directed toward developing gross motor skills. Some activity centers may be made of a plurality of subcomponents or objects that can be selectively disassembled and reassembled. In some instances a predetermined sequence of manipulations of the objects or components is required in order to successfully disassemble or reassemble the parts. In an exemplary embodiment, an activity board having multiple objects or components also has a removable cover. Removal of the cover, however, may also require a predetermined sequence of steps, such as by first removing a second object associated with the activity center.

The activity centers may be arranged and connected in several different ways. In one embodiment, the activity centers are arranged in a grid to form an activity board. Alternatively, the activity centers may be arranged in a stack where the front surfaces face in a common direction in a manner similar to a traditional book or magazine layout. In yet another embodiment, the activity centers may be connected in an accordion fashion where the connected activity centers may be connected side by side in a linear fashion. When folded in a zig zag or accordion manner, the front surfaces of the connected activity centers will alternate in the directions they face.

The connecting surfaces of the activity centers may have magnetic material, metallic material, a hook and loop configuration, Velcro, ball and socket, notch and groove, or other suitable ways for selectively connecting activity centers together.

In other embodiments of the invention, one or more of the activity centers may have a lockable cover panel. For instance, the cover panel further includes at least part of a latch, a combination lock, a chain lock, a deadbolt lock, or a sliding rod lock. In some embodiments, the content of one or more activity centers is directed toward reading development.

In other embodiments, the plurality of connected activity centers forms a story. As the need or desire to change the story arises, one or more activity centers from a second plurality of activity centers may replace one or more of the first plurality of activity centers to change the content.

The present invention also may be useful as an occupational therapy tool. In one embodiment, a first plurality of activity centers having a variety of themes, complexity, or content is once again provided. The activity centers may have two or more contact surfaces and may be joined together in a variety of ways.

These and other advantages of the present invention will be clarified in the Detailed Description of the Invention taken together with the attached drawings in which like reference numerals represent like elements throughout.

DETAILED DESCRIPTION OF THE INVENTION

As discussed above, the present invention uses interchangeable activity centers having a variety of themes, complexity, or content. Parents, therapists, users, or other persons can select, combine, and arrange two or more activity centers according to the user's interests and capabilities at that time. As the user develops greater skills or begins to lose interest, one or more of the activity centers may be removed, rearranged or substituted for one or more other activity centers. In this manner, a parent, therapist, or other person may maintain or renew interest in the toy or therapy device and continuously custom-tailor it for the user's changing interests, capabilities, or physical or mental development.

Activity centers may be designed to serve particular interests of a user, to help in certain types of development, or to serve as an occupational therapy tool. For instance, an activity center may have one or more puzzles that require manual operation in order to open a window or screen on the center. Opening the window or screen may in turn reveal an image, provide access to a chamber within the activity center, play a sound or turn on a light when opened, or do another similar activity. In other words, a reward of some type may or may not be provided for solving the puzzle on the activity center. In another embodiment, the activity center may be formed of a plurality of objects that can be assembled or disassembled when properly arranged, or alternatively when arranged according to a particular sequence.

Figure 1:
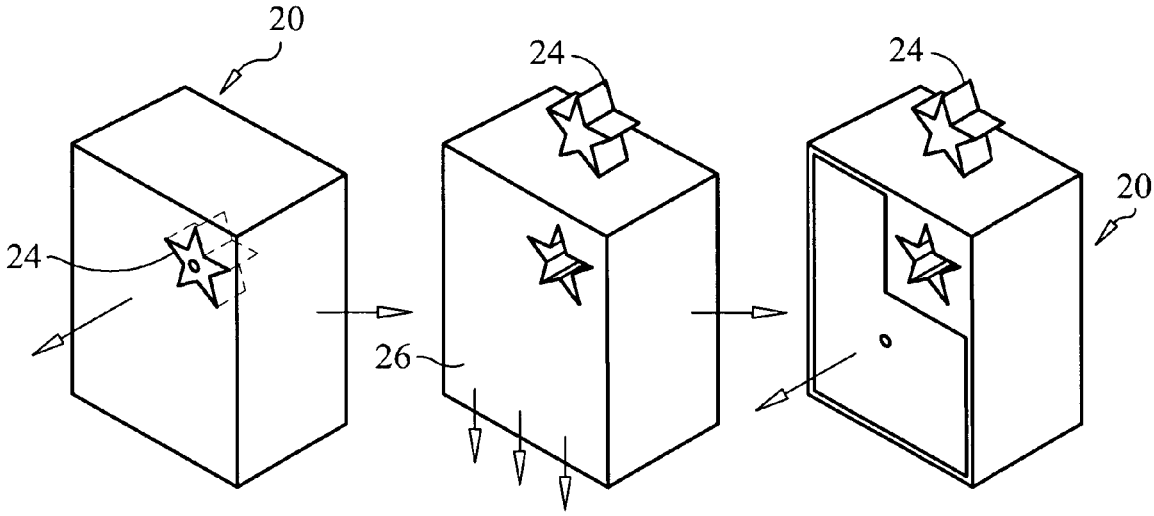
FIG. 1 illustrates an embodiment of an activity center of the present invention where the activity center involves an assembly of objects.
Figure 2:
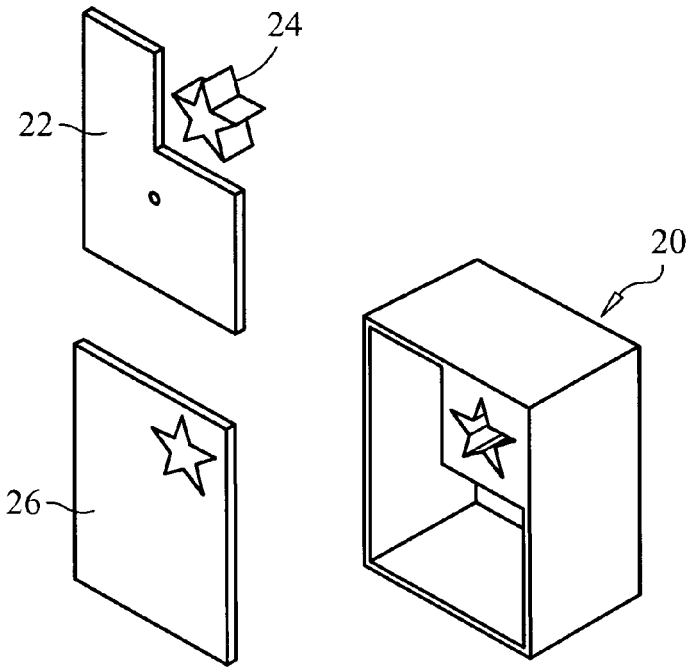
FIG. 2 illustrates the embodiment of FIG. 1 where the objects of the activity center are disassembled.

Many different types of puzzles may be provided on activity centers. For instance, each activity center may be an individual toy having a button, switch, latch, door, or similar device that a user may enjoy playing. One example of a puzzle illustrated in FIGS. 1 and 2 is an activity center 20 having multiple objects or components 22 that can be assembled and disassembled. As illustrated, disassembly of the activity center 20 may involve removing the objects 22 in a particular sequence, such as by first removing the star-shaped object 24 before other objects can be removed from the activity center. Once the star-shaped object 24 is removed, a cover panel 26 may then be removed from the activity center 20 by sliding it in a predetermined direction. Removal of the cover panel 26 may then reveal additional objects 22 inside the activity center 20 that also may be removed, or alternatively may allow viewing of an image or hearing of a sound, or may reward the user in some other way.

In is contemplated that the activity (game, puzzle, challenge, task, etc.) of an activity center may be attached to the center. However, in an exemplary embodiment, the activity is integrated into the center, i.e. the activity is built into the center. While the components and objects of the activity center may be disassembled and removed from the center during use, it should be understood that the components and objects become integrated into the center when the center is in an assembled state prior to and after a user plays with the activity center.

Figure 3:
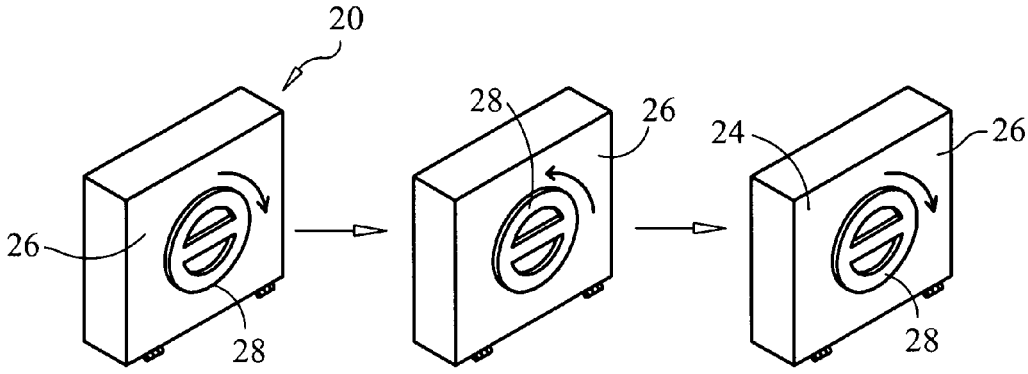
FIG. 3 illustrates another embodiment of an activity center of the present invention where the activity center involves a puzzle involving a sequence of movements.

Other puzzles may be directed toward manipulating an object or feature of an object associated with an activity center according to a predetermined sequence. FIG. 3, for example, illustrates an activity center 20 having a cover 26 with a rotatable dial 28 on its face. When the dial 28 is properly manipulated according to a predefined sequence of steps, the cover 26 can be opened to reveal the contents of the activity center 20. In this embodiment, the dial 28 may first be rotated to a first position, whereupon it may be pulled outward or pressed inward a predefined distance. Once the dial 28 is moved inward or outward, it may again be rotated until it reaches a second position and moved inward or outward once again. These steps may be repeated until eventually the dial 28 reaches a final position where the cover 26 is unlocked and may be opened to reveal the contents of the activity center 20. As shown, the cover panel 26 may be rotatably connected to the activity center 20 along one side.

Figure 4:
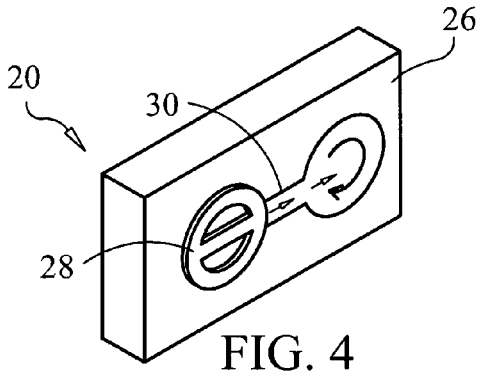
FIG. 4 illustrates a variation of the embodiment of FIG. 3 where the sequence of movements involved translating an object across a surface of the activity center.

While the combination of rotation and inward or outward displacement described above is illustrative, it should be understood that other sequences and types of movement or manipulation of objects also could be used. One example of a variation is illustrated in FIG. 4, where a dial 28 may be configured on an activity center 20 such that when it is rotated to a first position it can be translated from one location on the activity center 20 to another location. For example, once the dial 28 is in a first position, it may be capable of being slid to a second location or position through a channel or other translational throughway 30 formed in a portion of the activity center, such as the cover 26. This can be achieved, for instance, by configuring the dial 28 to have parallel edges that can be aligned to slideably engage with a channel or throughway 30 in the activity center 20.

Figure 5:
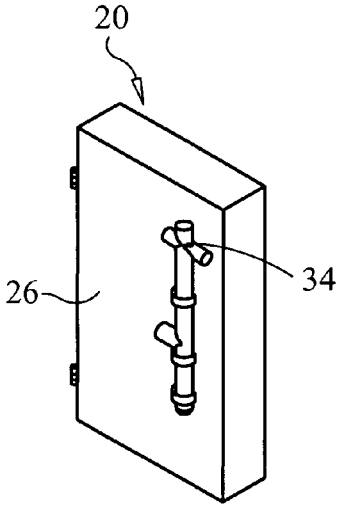
FIG. 5 illustrates an embodiment of an activity center of the present invention where the activity center involves a rotatable and sliding lock.
Figure 6:
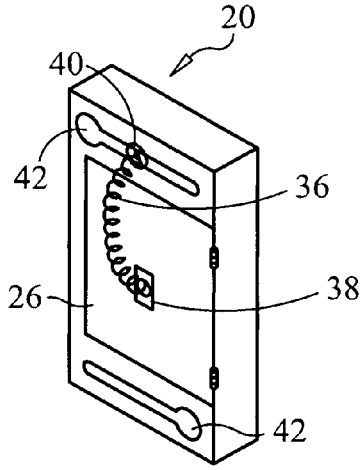
FIG. 6 is another embodiment of the invention where the activity center involves a puzzle involving a sequence of movements in order to unlock a cover.
Figure 7:
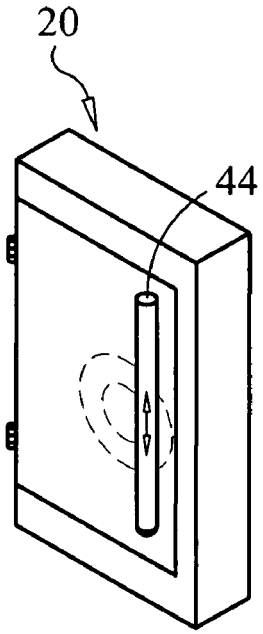
FIG. 7 is an embodiment of the present invention where an activity center has a sliding lock.

Other types of puzzles or locks of varying complexity and operation also may be provided on an activity center. For example, a cover 26 may be selectably locked to an activity center 20 with a rotatable and slidable lock 34 as illustrated in FIG. 5, while FIG. 6 shows a chain lock 36 where one end of the chain 38 is directly or indirectly connected to a cover panel 26 and a second end of the chain 40 can be slideably engaged with a recess and channel 42 formed on the activity center 20. FIG. 7 shows another variation of a puzzle or lock on an activity center 20. The puzzle or lock uses a sliding bar or rod 44 that can be moved from a first, locked position to a second, unlocked position.

Figure 8:
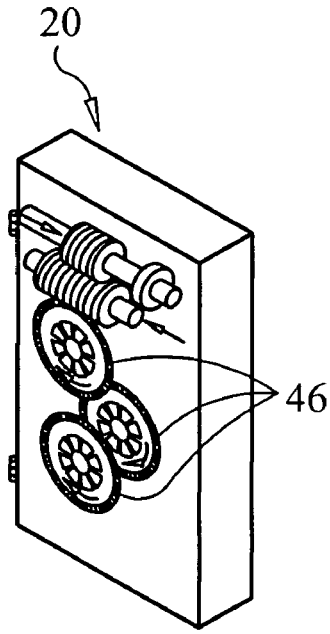
FIG. 8 illustrates an embodiment of the present invention where an activity center has a plurality of interconnected gears that may be rotated by a user.

Some puzzles or toys, such as illustrated in FIG. 8, may involve rotating one or more gears 46 that can be rotated or turned by a user. In an exemplary embodiment, a plurality of gears 46 are provided so that rotation of one gear causes one or more other gears to also rotate. The gears 46 may have different diameter sizes so that they have different rates of angular rotation. In these embodiments, the activity center may be configured with a transparent or translucent window that allows a user to witness the interaction of two or more gears 46 while also protecting a user from being pinched or otherwise hurt by the rotating gear teeth.

Figure 9:
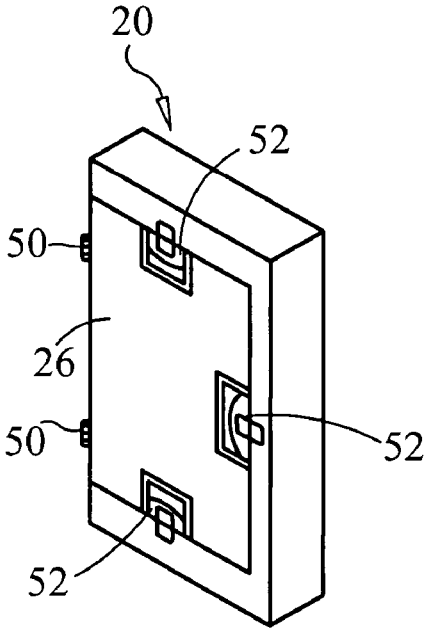
FIG. 9 is an embodiment of the present invention where a spring-loaded cover is connected to an activity center.

As mentioned above, a child or other user who succeeds at solving the puzzle or lock may be rewarded in many ways for their effort. In one embodiment shown in FIG. 9, solving the puzzle or lock causes the cover panel 26 to rapidly spring open. One way this can be accomplished is to provide spring-loaded hinges 50. FIG. 9 also shows that one or more latches 52 may be used to selectively lock the cover 26 to the activity center 20. As shown, two or more sides or edges of the cover 26 may be configured with latches 52. Operation of the latches can be similar to operation of window locking devices. A raised, curved surface of a pivoted or rotatable first component of the latch 52 can be selectively engaged with a channel or recess in a second component of the latch 52. One component is connected to a surface of the activity center while the other component is connected to the cover 26. In this manner, when the two components are engaged they prevent the cover 26 from being opened. FIG. 9 shows three edges of the cover 26 being configured with latches 52.

Figure 10:
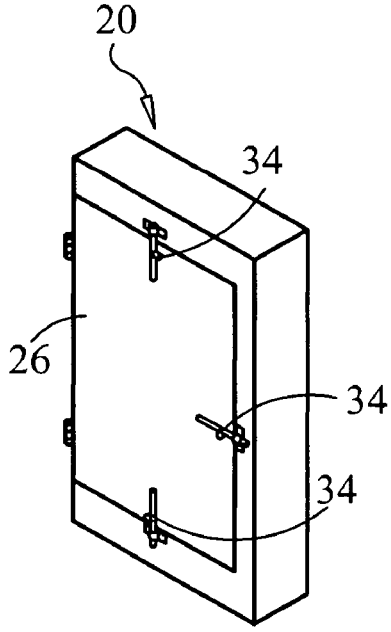
FIG. 10 is an embodiment of the present invention where an activity center has a plurality of latches for locking a cover in a closed position.

It should be understood that some or all of the features, components or configurations of one embodiment may be used in combination with or as a substitute for one or more features, components or configurations of another embodiment. In FIG. 10, for instance, the activity center 20 has three sliding locks 34 in a configuration similar to that of FIG. 9. Skilled artisans would appreciate that many other combinations and substitutions are possible without departing from the spirit and scope of the invention.

Figure 11:
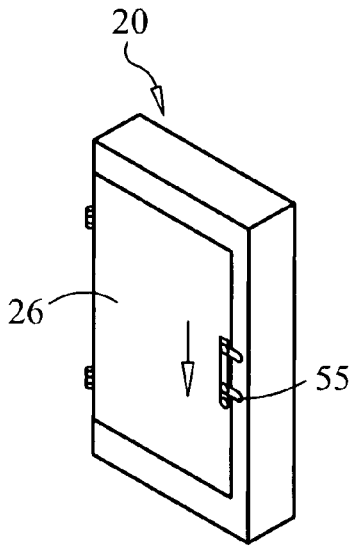
FIG. 11 is an embodiment of the present invention where a cover is held in a closed position against an activity center with a spring-loaded magnet.

In another embodiment, illustrated in FIG. 11, the lock or latch may be spring loaded so that an edge or side of the cover 26 rapidly moves away from the activity center 20. In yet another embodiment, other edges or surfaces of the activity center 20 may be compressed so that they apply a rapid opening force on the cover 26 when it is unlocked and released. The activity center 20 may be configured to also play a sound or song (or provide some other reward or stimulus) upon rapid opening of the cover 26.

Figure 12:
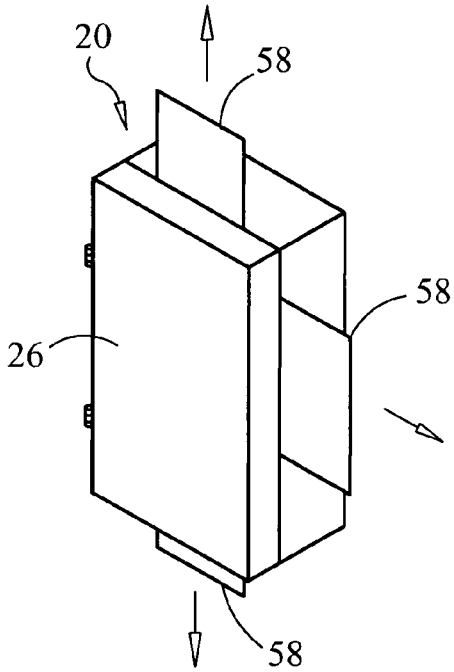
FIG. 12 illustrates an embodiment of the present invention where an activity center is unlocked by manipulating one or more slideable objects.

Another variation of a puzzle is illustrated in FIG. 12. In this embodiment, one or more interior panels or bars 58 may be moved from a first, locking position to a second, unlocked position. As shown in FIG. 12, the cover 26 of the activity center 20 may be unlocked once the interior panels or bars 58 are properly arranged. If a more complex puzzle is desired using the features of this embodiment, the movement or positioning of the interior panels or bars 58 may require a proper sequence in order to successfully unlock the activity center 20. In another alternative, movement of interior bars 58 may involve both translational movement as well as rotational movement. Even more complex puzzles may involve repositioning the interior panels or bars in a predetermined sequence.

Figure 13:
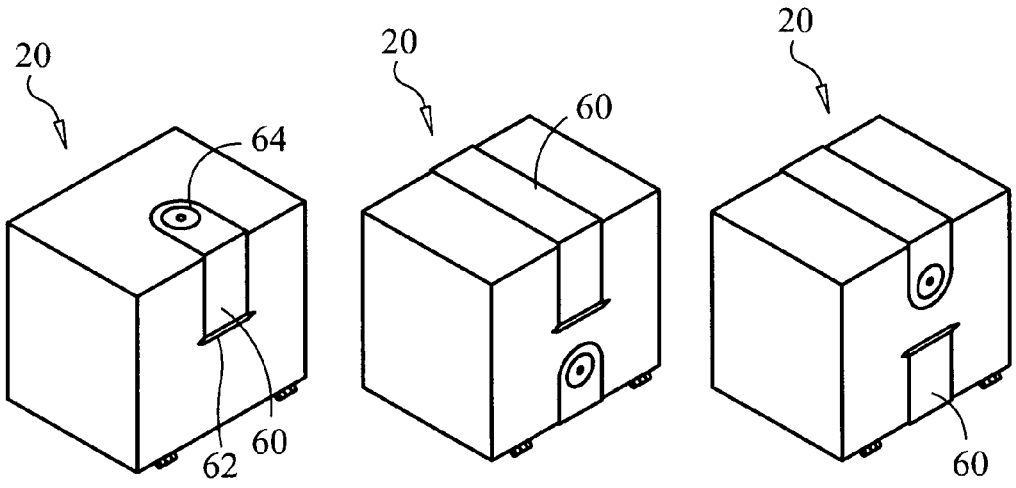
FIG. 13 illustrates embodiments of the present invention using a strap and lock to hold a cover in a closed position.

FIG. 13 shows that one or more straps 60 may be used to lock the activity center 20. For example, a webbing or strap 60 may extend across two or more surfaces of the activity center 20. One end 62 of the strap 60 may be connected to a cover 26 while the second end 64 may be connected to the activity center 20, the cover 26 or to another webbing or strap 60. Locking and release of the strap 60 may be accomplished by providing a locking clip. The locking clip may operate in any suitable manner, and may involve a variety of ways of releasing or unlocking, some being relatively easy while others being significantly more complex.

Figure 14:
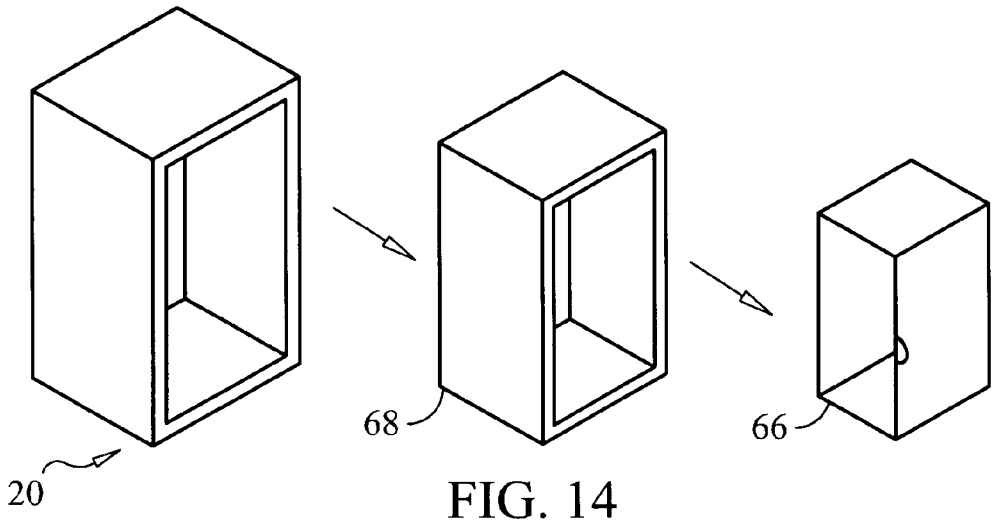
FIG. 14 is an embodiment of the present invention where an activity center has multiple objects nested within each other.
Figure 15:
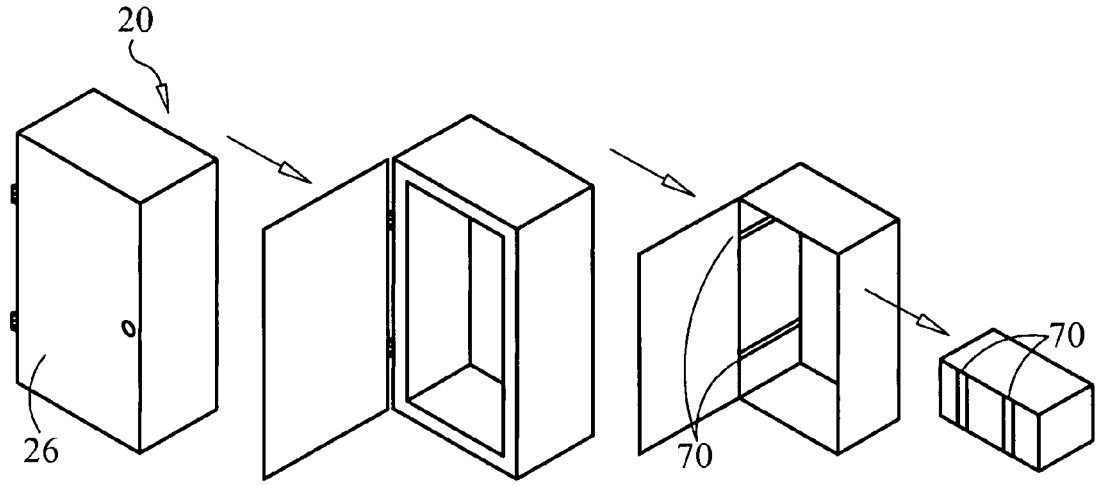
FIG. 15 is a variation of the embodiment of FIG. 14 where the objects are assembled according to a predetermined orientation or sequence.

Another type of puzzle that may be provided in an activity center is the use of one or more objects nested inside another object. Turning to FIGS. 14 and 15, for example, the interior space of an activity center 20 may have an object inside it. In turn, this object may have a space or recess formed therein where another object is located. Thus, FIG. 14 shows that one puzzle that may be provided by an activity center 20 may be as simple as a box 66 within a box 68. A more complex variation of this type of puzzle is illustrated in FIG. 15, which shows that the rearrangement of objects may require a particular orientation and sequence of assembly. The activity center may also include latches, locks, gears, boxes in boxes, and runners 70, or similar device, for sliding boxes into and out of other boxes.

Some puzzles may be directed toward learning to identify numbers or to applying numbers in mathematics, others may involve moving or positioning one or more physical elements or combining structural elements together in a particular way, while others may be directed toward learning geometric shapes. In addition, puzzles also may involve language learning, such as identifying letters or phonetic symbols or sounds, forming words or sentences, applying grammatical rules, or learning other language building blocks.

Figure 16:
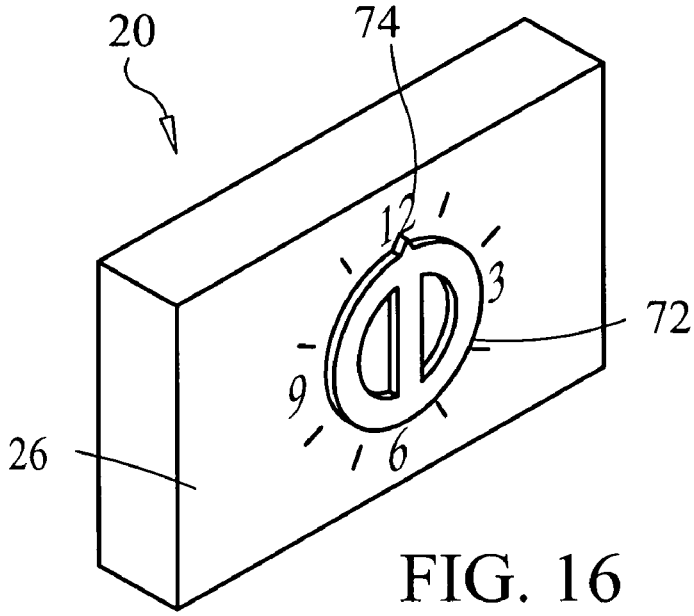
FIG. 16 illustrates an embodiment of an activity center of the present invention where the activity involves learning numbers.

One example of a mathematical puzzle, illustrated in FIG. 16, may be to associate an ordering of numbers or symbols with one or more buttons, dials or indicators 72 on the cover 26 or other surface of the activity center. One number or symbol 74 may be associated with each button so that a user pressing the buttons in the correct order will unlock a window or screen formed in the center or otherwise be rewarded for correctly identifying the ordering. The ordering may be sequential, such as numbers ordered from high to low or from low to high, or may be a predefined ordering. The ordering also may be changeable over time, such as by the parent, therapist, or user. Furthermore, the length of the sequence may vary from simple identification of a single number or symbol (i.e. asking the user to find the number "three") to a more complex ordering of multiple numbers or symbols.

Figure 17:
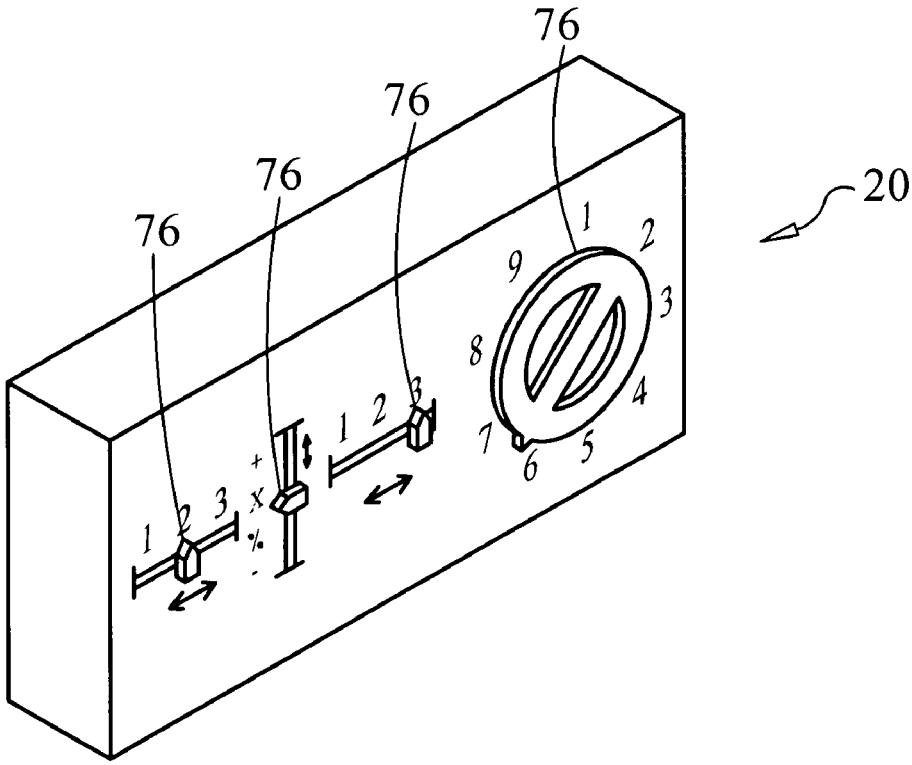
FIG. 17 illustrates an embodiment of an activity center of the present invention where the activity involves solving mathematical equations.

Another example of a mathematical puzzle may be for the activity center to provide one or more mathematical equations and provide a corresponding correct answer among a plurality of choices. This embodiment is shown in FIG. 17. Once again, a child or other user may be rewarded in some manner for correctly solving the mathematical equation. In one embodiment, shown in FIG. 17, the input to the mathematical equation may be varied so that the user can be exposed to and learn to solve a variety of numerical combinations instead of simply memorizing the answer to one equation. As shown in FIG. 17, one example of how this may be accomplished would be to provide a plurality of dials 76 that may be turned to designate different numerical inputs or mathematical functions. One skilled in the art having the benefit of this disclosure would appreciate that many other types of mathematical puzzles may be provided on an activity center. For instance, rather than using a mechanical combination or button, the activity center 20 may have one or more displays (or similarly audio outputs) that allow display of different numbers, values, or mathematical functions.

Another example of a puzzle may be an exercise that involves a user using their motor skills to accomplish a task. For instance, a puzzle may involve moving, rotating, orienting, connecting, or removing one or more components from another component of a puzzle. For example, an activity center may have a keyhole and a key associated with it. Placement of the key in the keyhole and, optionally, rotation of the key may then unlock a window so that the user may open a window or screen, as described above, or otherwise be rewarded in some manner. In one embodiment, rotation of the key in the keyhole may cause the activity center to provide an audible reward, such as by creating one or more audible clicks as it is rotated or by playing a one or more musical notes.

Other activity centers may involve placing objects having a predefined shape into receptacles on the center having a corresponding shape. For instance, the objects may have geometric shapes, such as triangles, squares, circles, stars, rectangles, parallelograms, or the like, and the center may have receptacles corresponding to the geometric shape. Alternatively, the objects may be combined together like a jigsaw puzzle to create an image.

Activity centers also may be arranged to form all or part of a story. For instance, a center may introduce a character, story line, or concept in a way that allows for combinations with a plurality of other centers. As the story develops, different centers may be combined or rearranged so that the story can have different outcomes. For example, one center may end with a character getting a surprise that is revealed on a subsequent center. The subsequent center may be selected from a variety of different types of centers describing different types of surprises, such as birthday presents, a family member or friend visiting them, or the like.

In another example, two or more centers may be interchanged with each other in a story to focus on one of a variety of related concepts. For example, the story may discuss colors, shapes, games, or the like that can be varied to maintain a reader's interest or to increase their exposure to related concepts in a familiar format. Thus, a story may have one or more centers describing the color red that may be interchanged with one or more centers describing the color blue, or centers describing triangles may be replaced by centers describing circles, squares, or other shapes. One or more centers also may focus on alphanumeric characters that can be arranged to spell words, names, addresses, phone numbers, or the like. Similarly, a plurality of centers may illustrate phonetic sounds that can be used and arranged in different ways to help learn to read and pronounce words, and a plurality of centers may illustrate words that can be arranged to form different sentences.

Figure 18:
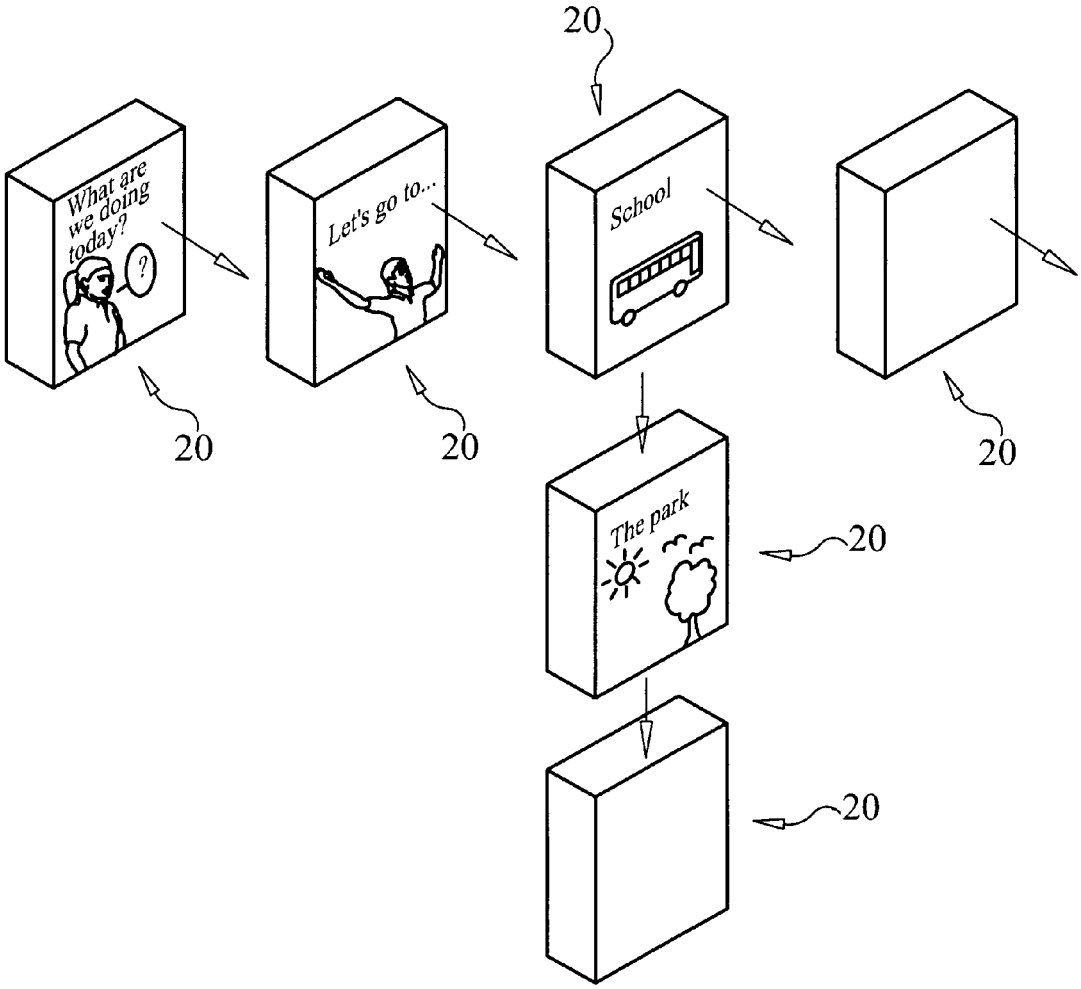
FIG. 18 illustrates an embodiment of an activity center of the present invention where a plurality of activity centers form a story.

As shown in FIG. 18, a plurality of activity centers 20 on a related subject also may be provided to allow for variation in the level of difficulty of complexity of the topic. For instance, some puzzles may be targeted toward developing gross motor skills, while more complex ones may involve fine motor skills and the performance of a series of steps. An activity center having a puzzle on it may be replaced by an activity center having a similar, but more complex puzzle. For example, an activity center having a puzzle involving turning a dial to a number may be replaced with a center requiring a dial having a two-number combination sequence. Likewise, some story centers may introduce more complex concepts or use more challenging words for a related concept. As a user becomes more capable of understanding more complex topics, a familiar story line may be expanded to introduce them.

The manner in which activity centers may be combined can be accomplished in several different ways. For instance, a plurality of centers may be connected along a common side or edge so that the centers can be stacked on top of each other and opened or explored in a manner similar to pages in a book. For example, a connecting side of an activity center may be configured with a hooked material on one side and looped material on the other so that as the centers are stacked so that the hooks and loops hold the centers together on a common side like a book. The connecting side of the activity centers may be flexible, hinged, or be configured with a living hinge so that a user may flip from one center to another more easily. In another embodiment, portions of the surface or edges of activity centers 20 may be magnetic. In yet another embodiment, edges or surfaces of two or more activity centers may be configured to enable them to be joined to form a hinge. As discussed elsewhere, the joining of a plurality of activity centers may be more easily facilitated through use of a base unit that connects or supports each of the activity centers.

Activity centers may be of any shape or configuration. The activity centers may be generally cube shaped, prism shaped, rectangular solid shaped, triangle shaped, circular or disc shaped, sphere shaped, or any other polyhedron shape. In an exemplary embodiment, the activity centers are cubes or rectangular solids (a three dimensional object with a rectangular cross section). When activity centers are to be joined together to form an activity board, at least two centers may include edges that are compatible for joining or mating. For example, two cube shaped centers may be connected together by two similar contact surfaces. Similarly, a cube shaped center may be connected to a triangle shaped center. All the activity centers of an activity board may have the same shape or configuration.

Figure 19:
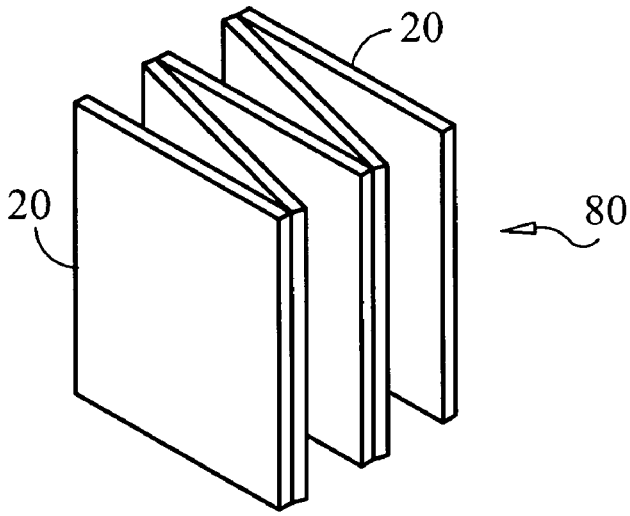
FIG. 19 shows an embodiment where activity centers are connected along alternating sides or edges.
Figure 20:
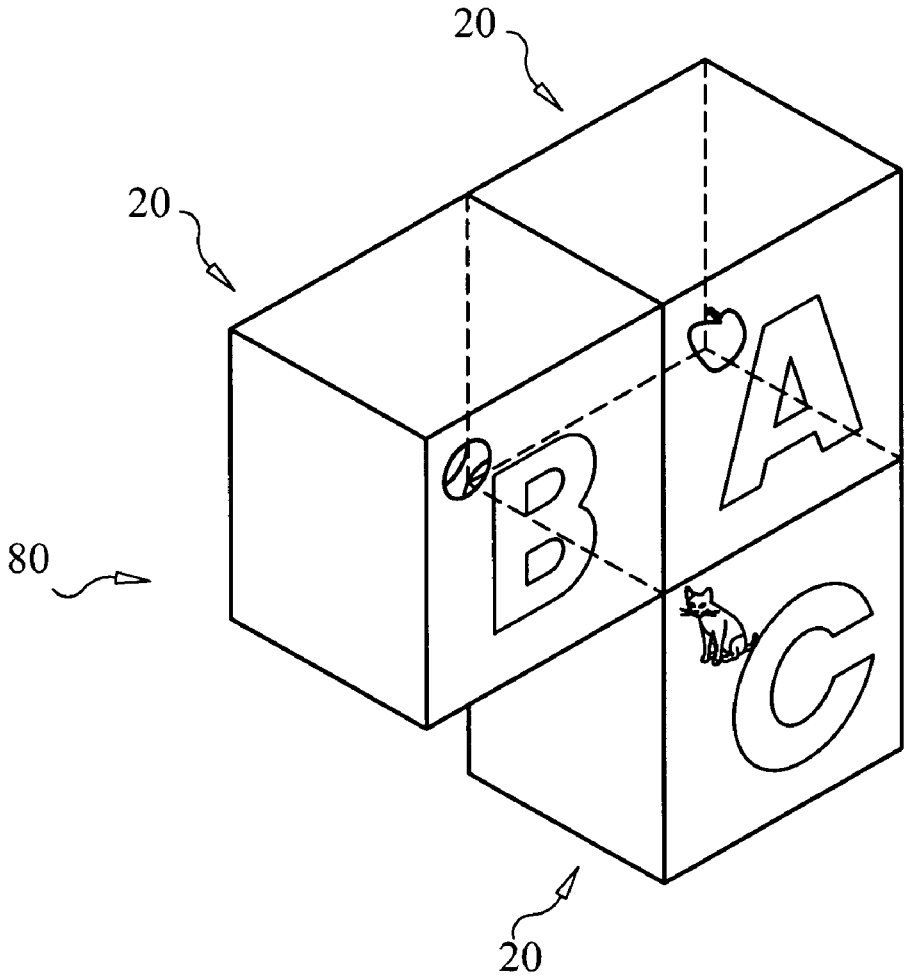
FIG. 20 shows an embodiment where activity centers are connected in a grid-pattern.

The activity centers 20 also may be connected on alternating, opposing sides as illustrated in FIG. 19. This arrangement may permit the activity centers to be arranged side by side along a surface, such as a floor or table top. If the connecting sides are configured to be flexible as described above, then the centers may be folded back and forth over each other so that they are more compact. The centers also may be configured so that they can connect with more than two other centers, such as arrangement according to a grid, as shown in FIG. 20. Such an arrangement or grid of activity centers forms an activity board 80. An activity board may tell a story or provide for mathematics, music, spelling, or reading. FIGS. 18-20 are examples of activity boards.

Connection of one activity center 20 to another may be accomplished in several different ways. For example, two activity centers 20 may be joined by abutting side edges or surfaces of the activity centers. As discussed above, activity centers 20 also may be joined by overlapping at least a portion of the upper or rear surfaces of an activity center 20 with at least part of a front or rear surface of a second activity center 20. As mentioned above, at least part of an edge or surface of an activity center may be formed of magnetic material. The use of magnetic material also may be beneficial for attaching activity centers to other metallic surfaces, such as a refrigerator door.

In another embodiment, the centers are not directly connected to each other, but instead are connected to a base unit. The base unit is sized to receive a plurality of activity centers and display them in a desired manner. For example, a base unit may form a portion of a spine of a book where two or more activity centers are stacked upon each other so that each center is analogous to a page of a book. When the activity centers are intended to be arranged in a grid-like pattern, the base unit may be a frame having a recess in which the activity centers reside. When the centers are arranged in a grid-like order with a base unit, the result of the collection of activity boards forms an activity board.

One benefit of the present invention is that an activity center may be sold separately and then combined with others. This allows each activity center to be provided at a lower cost than a full replacement of a toy, book, or game. It also allows for greater flexibility in custom-tailoring the arrangement of activity centers to suit a user's interests or developmental capabilities. Moreover, a plurality of activity centers discussing particular themes or concepts may also be sold for use with other activity centers. For example, a package of activity centers may be created for colors, animal sounds, phonetic symbols, beginning reading words, introductions to numbers, mathematics, and the like.

Similarly, it may be possible to buy add-on or replacement centers that correspond to a story. As shown in FIG. 18, this would allow a story of familiar characters liked by a child or other reader to have a variety of story lines. Likewise, substitute activity centers may be provided with progressively more complex mathematics topics. For example, one activity center in a set may be directed simply toward learning to recognize numbers, while another center in the set may be directed toward addition of single-digit numbers. Other add-on or replacement centers may be directed toward gradually increasing the level of manual dexterity required in order to interact with the activity center. Thus, puzzle packs may have a variety of easy to more complex puzzles or locks, and word packs may gradually introduce new words to a reader's vocabulary.

It is also contemplated that the present invention may include a timing device associated with the puzzles, games, or moving parts of the activity centers. The timing device may include an audible or visual means for indicating when time is up. A parent, teacher, or other person may set the timing device for a specific period of time in which the user is expected to complete the task or tasks of one or more activity centers. The timing device may provide for more advanced skills development of the user.

The various features of the invention have been described primarily in relation to a toy for education or entertainment. However, it will be appreciated that any of the features, such as the base unit and interchangeable activity centers, can be used on a therapy treatment device for users of all ages. Moreover, the features described are not limited to use only with the devices described herein. Thus, while the embodiments and variations described herein are illustrative of the invention, skilled artisans having the benefit of this disclosure would recognize many additional variations and modifications that do not depart from the scope of the invention. For example, a plurality of activity centers may be arranged or combined to form a game board on which players may play a game together. Using the concepts discussed above to this example, a skilled artisan would understand that one or more of the activity centers forming the game board may be interchangeable with other activity centers, thereby allowing the play of the game to be varied by the players.

What is claimed is:

1. An apparatus for developing human motor and mental skills in a user, comprising:

a plurality of activity elements having substantially similar outer dimensions, replaceably connectable along a contact surface to form a grid, each activity element including at least one challenge element having at least one movable part connected to said activity element and operative to challenge a mental or motor skill, the challenge met when said movable part is moved in a predetermined direction;

at least one of said at least one activity elements including a panel having an elongated channel;

a dial rotatably maintained within said channel;

indicia disposed upon said panel about the circumference of the dial;

means to retain said dial in rotatable disposition at one end of said channel;

means responsive to a position of said dial, operative to release said means to retain, whereby said dial may be moved to another position within said channel, when a predetermined dial position is set;

wherein activity elements are replaceable with other activity elements having different challenges, to maintain interest, or to increase a challenge as a user develops.

2. An apparatus for developing human motor and mental skills in a user, comprising:

a plurality of activity assemblies, each having a body and sized to be held in the hand, defining a front surface, a rear surface, a contact surface, each of said activity assemblies replaceably connectable along said contact surface to form a grid of activity assemblies, each activity assembly including at least one challenge element having at least one movable part connected to said activity assembly and operative to challenge a mental or motor skill, the challenge met when said movable part is moved in a predetermined direction, and at least one activity assembly having a challenge element including a panel movably connected to said at least one activity assembly and defining an interior space within said at least one activity assembly that is hidden when said panel is in a closed position, and revealed when said panel is moved to an open position;

reward means for stimulating the senses of the user, positioned within said interior space, said reward means sensed by the user when said panel is in said open position and said interior space is revealed;

at least one puzzle, including a movable puzzle part, for posing a challenge to the user to move said movable puzzle part from a first position to a second position;

blocking means for releasably blocking movement of said panel in connection to said body of the at least one activity assembly, retaining said panel in said closed position when said movable puzzle part is in a first position, and for unblocking movement of said panel and releasing said panel when said movable puzzle part is in a second position, whereby when said panel is opened said reward means for stimulating is revealed, indicating successfully solving the puzzle, and at least two of the plurality of activity assemblies challenging skills of differing difficulty relative to each other;

wherein said activity assemblies are substitutable, removable, rearrangeable and replaceable with other activity assemblies having different challenges, to thereby maintain the interest of the user, or to increase a challenge as a user develops.

3. The apparatus of claim 2, wherein said contact surface is substantially linear, and said activity element is substantially orthogonal.

4. The apparatus of claim 3, wherein each of said activity assemblies is connectable to at least two other activity assemblies to form a planar grid structure;

wherein said grid structure enables viewing of all connected activity assemblies, and wherein said activity assemblies are arrangeable to form an ordered sequence in accordance with a developmental objective.

5. The apparatus of claim 2, wherein said activity assemblies are connectable to at least two other activity assemblies to form a zig-zag structure that is collapsible or expandable;

wherein said movable puzzle part of one activity assembly may not be moved to said second position until a movable puzzle part of another activity assembly is moved to said second position, and wherein said activity assemblies are arrangeable to form an ordered sequence in accordance with a developmental objective.

6. The apparatus of claim 2, wherein said movable puzzle part is selected from the group consisting of: latch, combination lock, magnetic latched cover, rotatable dial, push and pull latch, sliding bar latch, rotating gears, shaped part and matching aperture, key and lock, audible clicker, hook and loop fastener, chain lock, deadbolt lock, sliding rod lock.

7. The apparatus of claim 2, wherein at least one of said activity assemblies includes a challenge element defining a mathematical puzzle including:

a plurality of movable value parts each operative to define a mathematical value;

at least one movable operator part operative to define a mathematical operator; and means to define a mathematical result of applying said at least one mathematical operator to said plurality of mathematical values;

whereby a user defines at least two mathematical values and a mathematical operator by moving said value and operator parts;

whereby a user defines a mathematical result calculated by the user as a result of applying said at least one defined mathematical operator to said plurality of defined mathematical values; and whereby when a correct mathematical result is indicated, said plurality of movable parts cause said movable puzzle part to move to said second position.

8. The apparatus of claim 2, wherein said reward means are selected from the group consisting of: bell, release latch, light, buzzer, noise, tones, music player, song player, pop-open cover, pop-open door.

9. The apparatus of claim 2, wherein said plurality of activity assemblies are connected to form a stack, wherein the front surfaces face in a common direction in a manner similar to a traditional book.

10. The apparatus of claim 2, wherein said plurality of activity assemblies are connected along alternating surfaces, wherein the front surfaces alternate in the direction they face when the apparatus is folded.

11. The apparatus of claim 2, wherein said movable puzzle part is moved in a translational direction.

12. The apparatus of claim 2, wherein at least one activity assembly is nested within another activity assembly.

13. The apparatus of claim 2, wherein said movable puzzle part includes a plurality of movable panels or bars extending from said interior.

14. The apparatus of claim 2, wherein said movable puzzle part is a shaped object inserted into a correspondingly shaped opening.

15. The apparatus of claim 2, wherein said movable puzzle part is at least one dial or gear rotated to a predetermined position corresponding to said second position.

16. The apparatus of claim 2, wherein said movable puzzle part is a plurality of mechanical latches.

17. The apparatus of claim 2, wherein said movable puzzle part is a plurality of straps.

18. An apparatus for aiding in the development of motor and mental skills of a user, comprising:

at least one activity block sized to be held in the hand of the user, and having a front surface, a rear surface, and a contact surface, for detachably connecting with the contact surface of a second activity block, said at least one activity block defining a normally enclosed interior space and a door that is movable between a first position preventing access to said interior space and a second position revealing and providing access to said interior space, said door having an outer surface visible to the user viewing said at least one activity block;

at least one manually manipulatable movable challenge means mounted on said outer surface of said door and having embodied therein a preselected puzzle that initiates from a first unsolved condition whereupon said door is held in its first position, and a second solved condition whereupon said preselected puzzle is solved and said door is free to move to said second position;

said at least one manually manipulatable movable challenge means posing a challenge to a user to solve said embodied preselected puzzle by manually manipulating said movable challenge means from its first unsolved condition to a second solved condition;

reward means for stimulating the senses of the user, positioned within said normally enclosed interior space, said reward means being revealed and sensed by the user when said door is moved to said second position;

wherein the development of the user's motor and mental skills are aided by manually manipulating said challenge means to find a solution to said preselected puzzle embodied therein; and wherein a plurality of such like activity blocks with different preselected puzzles can be detachably interconnected in an array of said activity blocks.

19. The apparatus of claim 18, wherein a group of like blocks are provided having challenge means embodying different preselected puzzles, said group of blocks being arranged in one of a variety of arrays with any one block in the array being able to be removed, repositioned in the array, or substituted by another activity block, to maintain the interest of the user, as the user's motor and mental skills progressively develop.

* * * * *